US006149371A

United States Patent [19]

De Vries et al.

[11] Patent Number: 6,149,371

[45] Date of Patent: Nov. 21, 2000

[54] REFUSE HANDLING VEHICLE

[75] Inventors: Peter De Vries, Bonnyrigg; Michael Allen Houston, Penrith; Leslie James McHugh, Middle Dural; David John Horrocks, Putney; Barry John Ommundson, Dundas, all of Australia

[73] Assignee: Garwood International Pty. Limited, Wetherill Park, Australia

[21] Appl. No.: 09/152,522

[22] Filed: Sep. 14, 1998

Related U.S. Application Data

[63] Continuation-in-part of application No. PCT/AU97/00138, Mar. 6, 1997, abandoned.

[30] Foreign Application Priority Data

| | | | |
|---|---|---|---|
| Mar. 12, 1996 | [AU] | Australia | 8637 |
| Sep. 12, 1996 | [AU] | Australia | 2280 |
| Mar. 20, 1998 | [AU] | Australia | 2513/98 |

[51] Int. Cl.[7] ..... B65F 3/20

[52] U.S. Cl. ..... 414/525.2; 414/493

[58] Field of Search ..... 414/525.2, 525.3, 414/525.4, 525.5, 492, 493

[56] References Cited

U.S. PATENT DOCUMENTS

| | | | |
|---|---|---|---|
| 2,561,608 | 7/1951 | Boissonnault | 414/525.4 |
| 3,462,031 | 8/1969 | Weir | 414/525.2 |
| 4,096,959 | 6/1978 | Schaffler | 414/525.5 |
| 4,844,675 | 7/1989 | Strosser et al. | 414/493 |
| 5,402,716 | 6/1995 | Holtom | 414/525.5 |
| 5,427,496 | 6/1995 | Ratledge, Jr. et al. | 414/525.2 |
| 5,458,058 | 10/1995 | Zeronian et al. | 414/525.2 |
| 5,513,942 | 5/1996 | Pickrell | 414/525.2 |
| 5,551,824 | 9/1996 | Zanzig et al. | 414/525.5 |
| 5,931,628 | 8/1999 | Christenson | 414/525.2 |

FOREIGN PATENT DOCUMENTS

| | | | |
|---|---|---|---|
| 81697/91A | 2/1992 | Australia . | |
| WO 94/11277 | 5/1994 | Australia | 414/525.3 |
| 45911 | 11/1959 | France | 414/525.3 |
| 2241597 | 2/1974 | Germany | 414/525.3 |
| 506549 | 5/1976 | U.S.S.R. | 414/525.2 |
| 715391 | 2/1980 | U.S.S.R. | 414/525.2 |
| 2138386 | 10/1984 | United Kingdom | 414/525.2 |

*Primary Examiner*—Dean J. Kramer
*Assistant Examiner*—Paul T. Chin
*Attorney, Agent, or Firm*—Jacobson, Price, Holman & Stern, PLLC

[57] ABSTRACT

A refuse handling assembly for use with a vehicle, including a receptacle for receiving refuse the receptacle having a delivery inlet opening at the forward end of the receptacle and a discharge outlet opening at the rearward end of the receptacle. The receptacle is operatively mounted to the vehicle for pivotal movement about a pivot mounting at or near the rear end of the vehicle for pivotal movement between a lowered position and a tilted position. There is further provided a compactor at the delivery inlet opening having a sweep blade which has its pivot axis laterally offset with respect to the longitudinal axis of the receptacle.

19 Claims, 7 Drawing Sheets

REFUSE HANDLING VEHICLE

CROSS-REFERENCE TO RELATED APPLICATION

This is a continuation-in-part of International Application No. PCT/AU97/00138 with an International filing date of Mar. 6, 1997 now abandoned.

BACKGROUND OF THE INVENTION

1. Field of the Invention

This invention relates generally to the handling of refuse and more particularly to refuse handling apparatus which is suitable for use with a vehicle.

2. Description of the Related Art

Refuse handling vehicles are known and may include a refuse receiving receptacle mounted on the back of a truck. Usually a compactor is provided for compacting the material within the receptacle. These compactors can take various forms. The compacted material is adapted to be discharged from the vehicle when the receptacle is full. Usually these vehicles are quite large and therefore cannot be used in all areas where refuse needs to be collected. As a result of this it is often necessary to manually collect the refuse in these inaccessible areas and transfer it to the refuse collecting vehicle wherein it is subsequently compacted. It will be appreciated that this is an inefficient and time consuming operation.

SUMMARY OF THE INVENTION

An object of the present invention is to provide improvements to refuse handling apparatus which is suitable for use with a vehicle which can be smaller than those normally used at present.

According to one aspect of the present invention there is provided a refuse handling assembly for use with a vehicle, the vehicle including a forward end and a rear end, the refuse handling assembly including:

a receptacle for receiving refuse the receptacle including delivery inlet opening at the forward end of the receptacle and a discharge outlet opening at the rearward end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle.

According to yet another aspect of present invention there is provided a refuse handling assembly for use with a vehicle, the vehicle including a forward end and a rear end, the refuse handling assembly including:

a receptacle for receiving refuse the receptacle including a delivery inlet opening at the forward end of the receptacle and a discharge outlet opening at the rearward end of the receptacle, said receptacle being operatively mounted to the vehicle for pivotal movement about a pivot mounting at or near the rear end of the vehicle for pivotal movement between a lowered position and a tilted position wherein said discharge outlet opening extends between the pivot mounting and a top wall of the receptacle and opening is in a plane which is inclined forwardly and upwardly from the pivot mounting.

According to yet another aspect of the present invention there is provided a refuse handling assembly for use with a vehicle, the vehicle including a forward end and a rear end, the refuse handling assembly including:

a receptacle for receiving refuse the receptacle including a delivery inlet opening at the forward end of the receptacle and a discharge outlet opening at the rearward end of the receptacle, said receptacle being operatively mounted to the vehicle for pivotal movement about a pivot mounting at or near the rear end of the vehicle for pivotal movement between a lowered position and a tilted position wherein said receptacle includes a bottom wall having a first section which is adjacent a base section of a chassis of the vehicle when the receptacle is in the lowered position and a second section which is inclined upwardly from the first section and terminates at or in the region of the discharge outlet opening.

Preferably the free end of the mounting section of the support frame is disposed rearwardly of the rear end of the base section of the vehicle chassis. Thus the pivot mounting can be the rearmost part of the apparatus and vehicle, when the apparatus is mounted on the vehicle.

In one preferred form the receptacle includes a bottom internal wall having a first section which is adjacent the base section of the chassis when the receptacle is in the lowered position and a second section which is inclined upwardly from the first section and terminates at or in the region of the discharge outlet opening. The receptacle may further include a top wall side walls and front and rear end walls. Preferably the discharge outlet opening is between the rear end wall and the top wall with its peripheral edge being inclined between the end wall and top wall. Preferably the discharge outlet opening extends between the pivot mounting and a top wall of the receptacle in a plane which is inclined upwardly and forwardly from the pivot mounting.

The apparatus may further include a compactor which is disposed at the delivery inlet opening. In one preferred form, the compactor includes a base wall, an open top for receiving the refuse and a sweep blade mounted for pivotal movement so as to sweep across the base so as to push refuse through the inlet opening.

Preferably, the pivot mounting, which may be in the form of a post to which the sweep blade is mounted and the base wall of the compactor are inclined so that material is fed upwardly into the compactor. The base wall may extend into the receptacle and terminate at a step within the receptacle which steps down from the free edge of the base wall of the compactor to the bottom wall of the receptacle. Preferably, the inclined base wall and section of the bottom wall are inclined at approximately the same angle.

Preferably the apparatus further includes a closure assembly for the discharge outlet opening the closure assembly including a door which is movable between a closed position in which it abuts against an abutment at the periphery of the discharge outlet opening and an open position, the closure further including a control arm operatively connected to the door and mounted for pivotal movement and limited linear movement so as to move the door between its open and closed positions.

The arrangement is such that when the door is to be moved between its closed position to its open position the control arm is first caused to move in the limited linear fashion so that the door is moved to a displaced position in which is clear of the abutment and thereafter the control arm is caused to move in the pivotal fashion to move the door into its open position.

When the door is to be moved from its open position to its closed position the control arm first moves in the pivotal fashion until the door is in the displaced position and thereafter the arm is caused to move in the linear manner so that the door is caused to abut against the abutment. In one form of the invention, the peripheral edge surrounding the discharge outlet opening include an upstanding extending rib at least partially therearound. In the closed position the door is adapted to sit within the confines of this rib. This arrangement provides ad additional seal and also a locking arrangement for the door. Preferably mounting means for the control arm includes a pin which is receivable within a slot for causing the pivotal movement and limited linear of the arm by movement of the pin relative to the slot. A stabiliser arm may be provided which extends between the pivot arm and the closure. The limited linear movement enables the door to be displaced linearly so as to clear the peripheral ribs before the door swings to the open position.

The closure assembly may form a separate and distinct invention.

Thus according to yet another aspect of the present invention there is provided a closure assembly suitable for use with a refuse handling apparatus which includes a discharge outlet opening the closure assembly including a door moveable between a closed position in which it abuts against an abutment at the periphery of the discharge outlet opening and an open position, the closure assembly further including a control arm operatively connected to the door and mounted for pivotal movement and limited linear movement so as to move the door between its open and closed positions.

The arrangement is such that when the door is to be moved between its closed position to its open position the control arm is first caused to move in the limited linear fashion so that the door is moved to a displaced position in which is clear of the abutment and thereafter the control arm is caused to move in the pivotal fashion to move the door into its open position. When the door is to be moved from its open position to its closed position the control arm first moves in the pivotal fashion until the door is in the displaced position and thereafter the arm is caused to move in the linear manner so that the door is caused to abut against the abutment.

In one form of the invention when in the closed position the door is adapted to sit within the confines of a peripheral rib at least partially surrounding the opening. Preferably mounting means for the control arm includes a pin which is receivable within a slot for causing the pivotal movement and limited linear movement of the arm by movement of the pin relative to the slot, the limited linear movement enabling the door to be displaced linearly so as to clear the peripheral rib before the door swings to the open position.

According to a further preferred embodiment of the present invention the assembly in any of the aspects described above may further include a hinged panel in a wall of the receptacle adjacent the closure assembly and operable so as to be movable between a closed position and an open position the panel being held in the closed position when the closure assembly is closed and movable to the open position when the closure assembly is opened.

Preferably, the panel is hinged at one end remote from the closure assembly with its free end adjacent the closure assembly. Preferably, the panel is in the top wall of the receptacle and is retained in the closed position by the door of the closure assembly when in its closed position.

According to a further aspect of the present invention there is provided a compactor for refuse handling apparatus having a sweep blade which has its pivot axis laterally offset with respect to the longitudinal axis of the receptacle.

By offsetting the pivot axis this allows for a greater swept volume to be generated. The offset can be to either side to accommodate left or right hand loading. Without this offset, the unit is less effective as a refuse collector.

The sweep blade preferably includes a curved face panel which pivots about a centre pivot shaft oscillating forwards and backward in a generally horizontal plane. In its forward motion the panel sweeps clean the area of the hopper and propels under hydraulic pressure the refuse contained in the hopper into the body proper. The panel preferably projects into the body at the extremity of its forward most travel. As the panel retracts, any refuse sitting on top of the panel drops down into the hopper. Refuse is prevented from passing under the rear most edge of the hopper by a sweeper panel which is a close fit into the top of the packer panel. The refuse is carried into the body during the subsequent forward packing stroke of the panel.

The panel is preferably driven by a hydraulic cylinder, the cylinder being mounted with the base end contained in a bracket fixed to the rear periphery of the hopper bowl. The rod end of the cylinder is preferably fixed to the rear of the packer panel.

Preferably, the assembly includes a forward mounted, side loading receiving hopper with the compactor mechanism having a blade which has its pivot axis laterally offset with respect to the central longitudinal axis of receptacle. The base wall of the hopper may be inclined downwards at the front end and the pivot shaft is inclined forward at its top end to allow the blade to move in a parallel plane to the inclined floor.

There is a preferably step or rise situated on the base plate at the point where the base plate angle becomes parallel with the chassis to prevent the material sliding back down to the hopper area. At the end of the parallel base plate at a point below the forward projection of the roof hatch or cover the base plate rises at an angle to meet the rearward point of the closure of the roof hatch or cover.

At the rear end of the receptacle a lifting and pivoting rear cover or hatch is positioned over the aperture which when opening moves in a upward or forward motion to allow either discharge of the compacted material on opening of the aperture during the normal frontal loading procedure without spillage of material already contained within the receptacle. This forward motion of the rear hatch/cover allows a controlled discharge of material from the receptacle without impedance.

According to yet another aspect of the present invention there is provided a refuse handling assembly which is suitable for use with a vehicle, the assembly including a receptacle for receiving refuse, the receptacle including a delivery inlet opening, a compactor at the delivery inlet opening having a sweep blade for feeding refuse in a feed direction through the delivery inlet opening into the receptacle and for compacting the refuse within the receptacle and feed control means which includes one or more projections adapted to extend into the region of the delivery inlet opening and movable in the feed direction but normally inhibited from movement in a direction opposite to the feed direction.

The arrangement is such that the projections will move through the region of the delivery inlet opening when the sweep blade is feeding refuse into the receptacle but when the sweep blade is retracted the projections assist in inhibiting refuse from returning through the delivery inlet from the interior of the receptacle.

In one preferred form the feed control means includes a main body which is mounted for rotation there being a plurality of the projections extending from the main body so that rotation thereof causes the projections to pass through the region of the delivery inlet opening in the feed direction.

The main body of the feed control means may be in the form of a roller or drum which is operatively mounted to the receptacle or vehicle body for rotation about a generally horizontal axis. Preferably, the projections are adapted to extend generally radially from the surface of the roller or drum. It is to be understood that the word radially as used in this context includes projections which extend in a direction offset from the true radial axis of the roller or drum. For example, they may be inclined forwardly or rearwardly of the true radially axes of the roller or drum.

In one preferred form the projections include a plurality of elongated upstanding flanges or paddles secured to the outer drum surface and extending generally in the longitudinal direction parallel to the rotation axis and projecting from the other roller or drum surface. Preferably, a plurality of flanges or paddles are provided which are spaced from one another circumferentially around the roller or drum surface.

In another form of the invention the projections include a plurality of tynes disposed over the outer roller or drum surface in spaced relation from one another and extending therefrom in a generally radial direction.

Preferably, the roller or drum is mounted in suitable roller load bearing and have associated therewith a clutch which permits rotation in one direction only.

The roller may be mounted towards the top of the delivery inlet opening or alternatively towards the bottom of the opening.

BRIEF DESCRIPTION OF THE DRAWINGS

Preferred embodiments of the invention drawings will hereinafter be described with reference to the accompanying drawings and in those drawings.

DETAILED DESCRIPTION OF THE INVENTION

Figure 1:
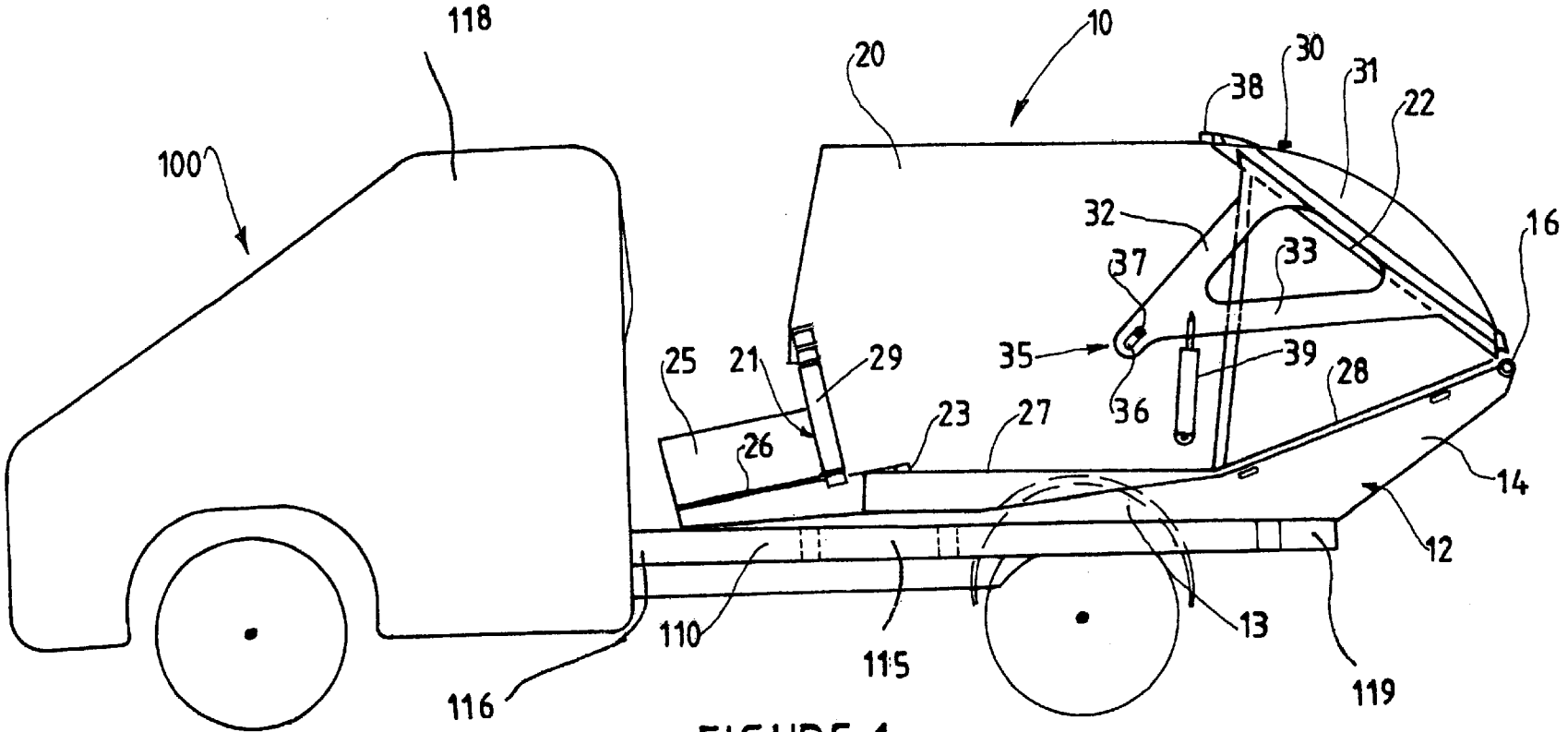
FIG. 1 is a schematic side elevation of a vehicle with the refuse handling assembly according to one preferred embodiment of the invention mounted thereon.

Referring to the drawings there is shown a refuse handling assembly generally indicated at 10 mounted on a vehicle 100 the vehicle having a chassis 110 which includes a base section 115 housing a forward end 116 which supports a vehicle cabin 118 and rear end 119.

The refuse handling assembly 10 includes a receptacle 20 which is carried on the receptacle support frame 12 having first and second sections 13 and 14. The first section 13 of the support frame 12 is adapted to be mounted to the vehicle chassis 110. The second section 14 of the support frame 12 is inclined upwardly relative to the first section 13 so that its free end is disposed rearwardly and upwardly relative to the vehicle chassis 110.

Figure 2:
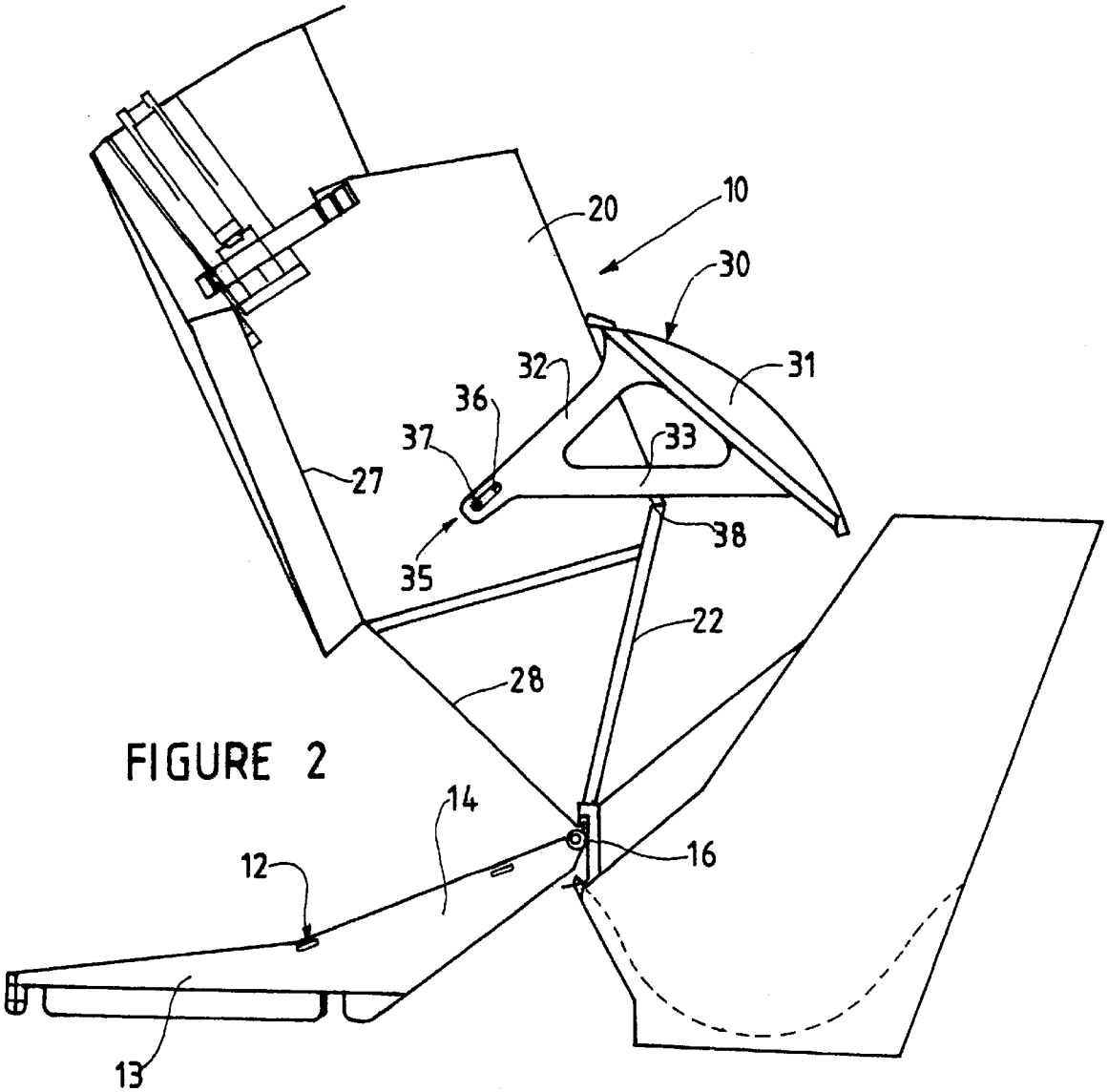
FIG. 2 is a schematic side elevation of the refuse handling assembly as shown in FIG. 1 in a tilted position.

The receptacle 20 for receiving refuse includes a top wall, side walls, end walls and a bottom wall with a delivery inlet opening 21 at the forward end of the receptacle and a discharge outlet opening 22 at the rearward end of the receptacle. The receptacle 20 is pivotally mounted to the support frame 14 at pivotal mounting 16 so as to be pivotable between a lowered position as shown in FIG. 1 and a tilted position as shown in FIG. 2.

A compactor 25 is disposed at the delivery inlet opening 21. The compactor includes a sweep blade 47 having a curved front face 48 shown in phantom in FIG. 4 which is mounted for pivotal movement about pin 29 which as shown is inclined so that the sweep blade pushes the refuse inwardly and upwardly. The compactor is opened at its top side so that refuse can be dumped within the compactor and forced into the receptacle by operation of the compacting paddle. The compactor has a base wall 26 which is also inclined relative to bottom wall section 27 of the receptacle 20. The base wall 26 extends into the receptacle and terminates at a step 23. This arrangement tends to inhibit refuse material being dragged along the bottom wall section 27 when it is being fed into the receptacle on returning towards the opening.

The receptacle 20 further includes a bottom wall section 28 which extends upwardly from bottom wall section 27 and terminates at discharge outlet opening 22.

The assembly further includes a closure assembly 30 comprising a door 31 and a control arm 32 operatively connected to the receptacle via coupling section 35. A stabiliser arm 33 is also provided.

The coupling section 35 includes a pin 37 which is receivable in a slot 36 formed in the control arm 32 so that the closure is capable of pivotal movement about pin 37 and limited linear movement along slot 36. In the closed position the door 31 is seated behind a rib 38 which extends at least across the top of the opening. This ensures that a relatively good seal is provided between the door and the opening 22 when closed. When the door is moved into its open position it needs to firstly move linearly by relative movement between the pin and slot so that is clears the rib 38 and thereafter it can be pivoted around to the position shown in FIG. 2. An actuator which may be in the form of an hydraulic piston cylinder assembly 39 is provided for moving the closure door. A further hydraulic piston cylinder assembly causes movement of the receptacle between its tilt and lowered positions.

Figure 3:
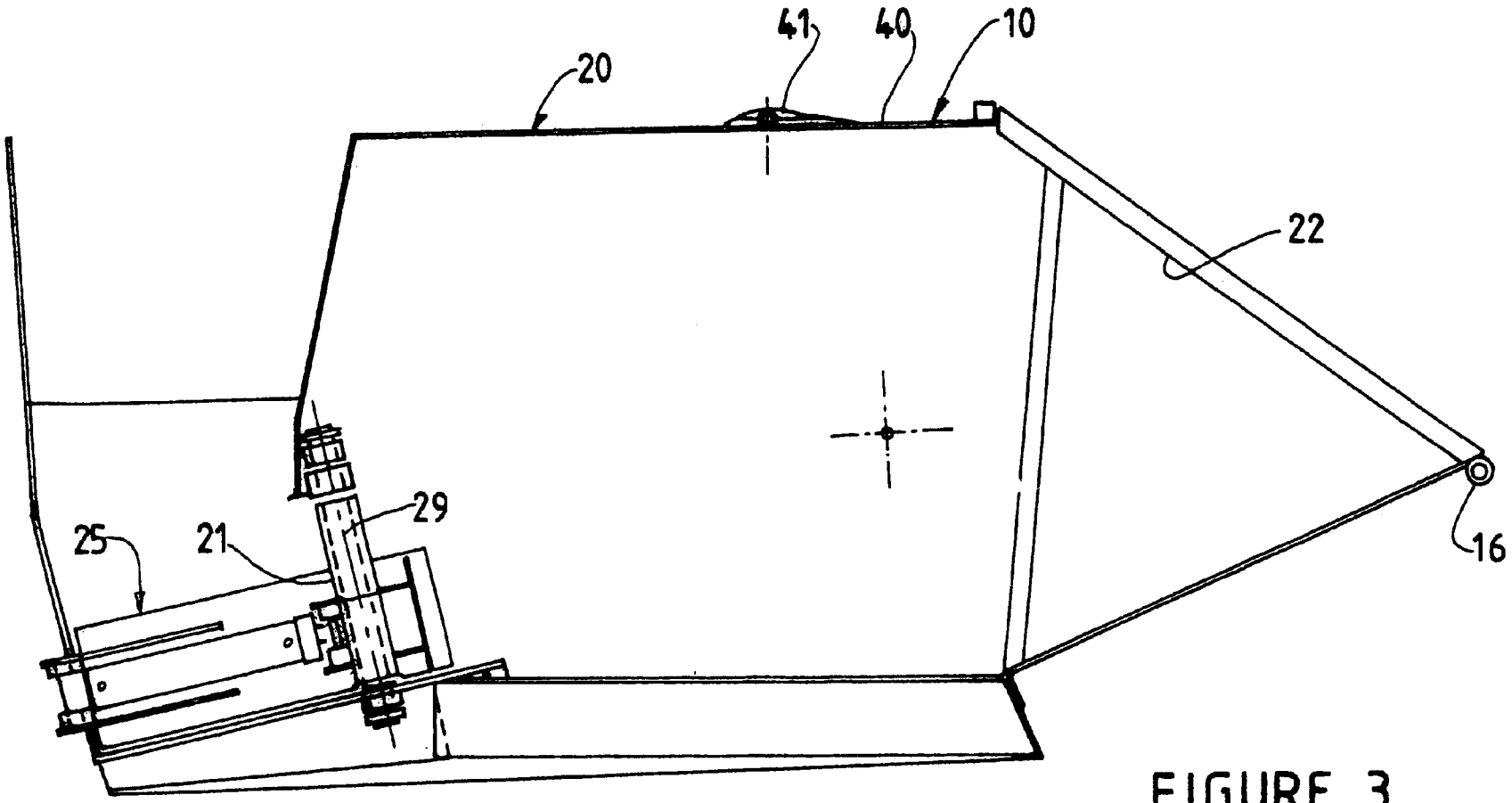
FIG. 3 is a schematic side elevation of a further embodiment of refuse handling assembly according to the invention.
Figure 4:
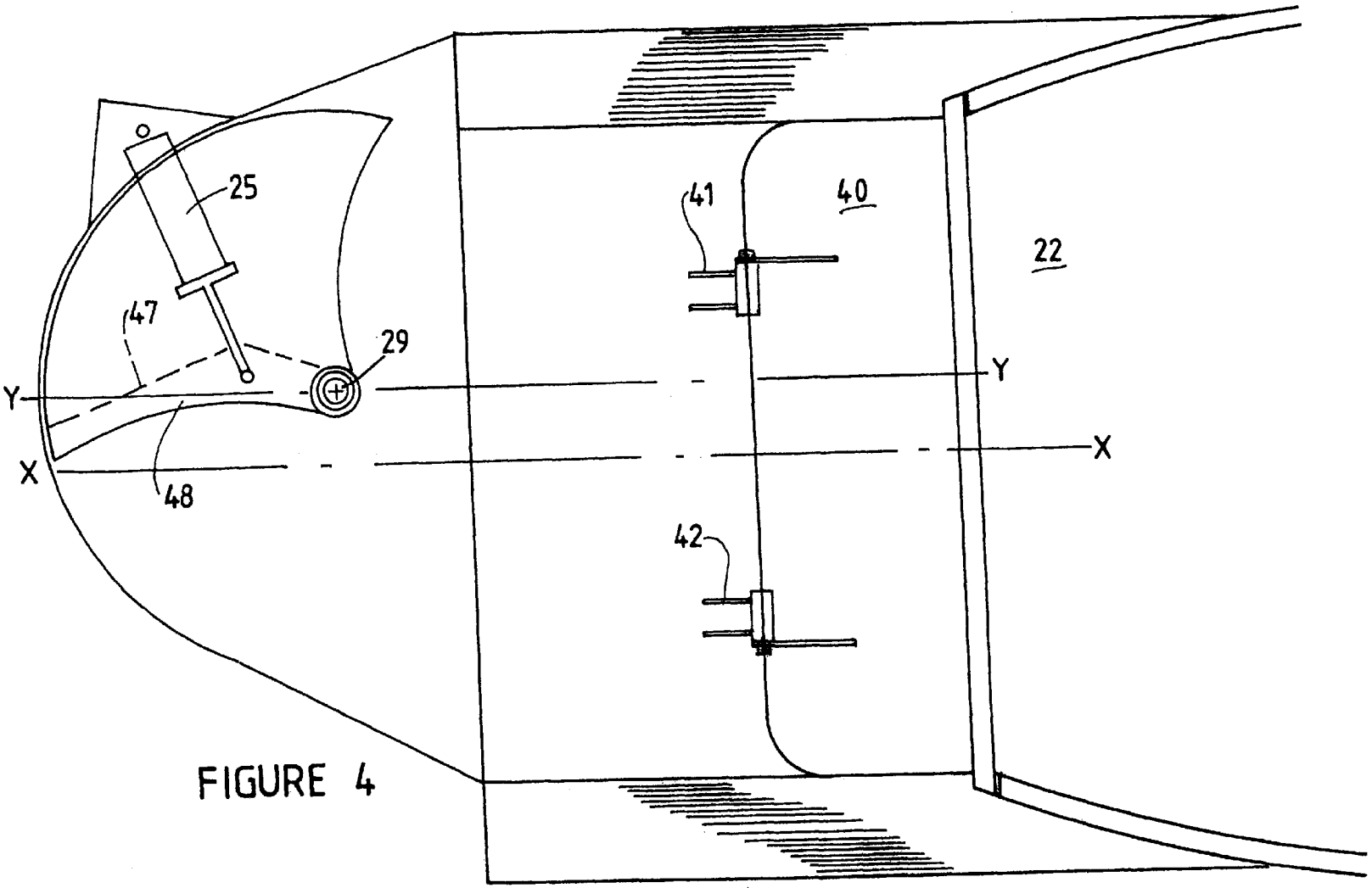
FIG. 4 is a schematic plan view of the assembly shown in FIG. 3.

Referring to FIGS. 3 and 4, the assembly is generally the same as that described in FIGS. 1 and 2 except that there is provided a hinged panel 40 pivotally mounted by hinges 41 and 42 in the top wall of receptacle 20. The hinged panel is held in its closed position by the door which closes opening 22 (not shown) and swings open when the door is moved into its open position and the receptacle is tilted.

As best seen in FIG. 4, the pivot axis of sweep blade 47 about pin 29 of the compactor 25 is laterally offset along axis Y—Y to the central axis X—X of the assembly.

The apparatus of the present invention has several advantages. For example the inclined section of the internal wall causes material to be directed towards the discharge outlet. Furthermore, the position of the pivotal mounting of the receptacle enables the material to be discharged directly into the rear of a larger truck or storage bin.

The arrangement of the pivot mounting being in essence the most further rear part of both the apparatus and vehicle ensures that the apparatus can be positioned adjacent the larger truck or storage bin without any interference. The position of the control arm in pivot mounting ensures that the door will remain relatively low profile in its raised position. The linear/pivotal movement ensures a good seal and lock when in the closed position.

Figure 5:
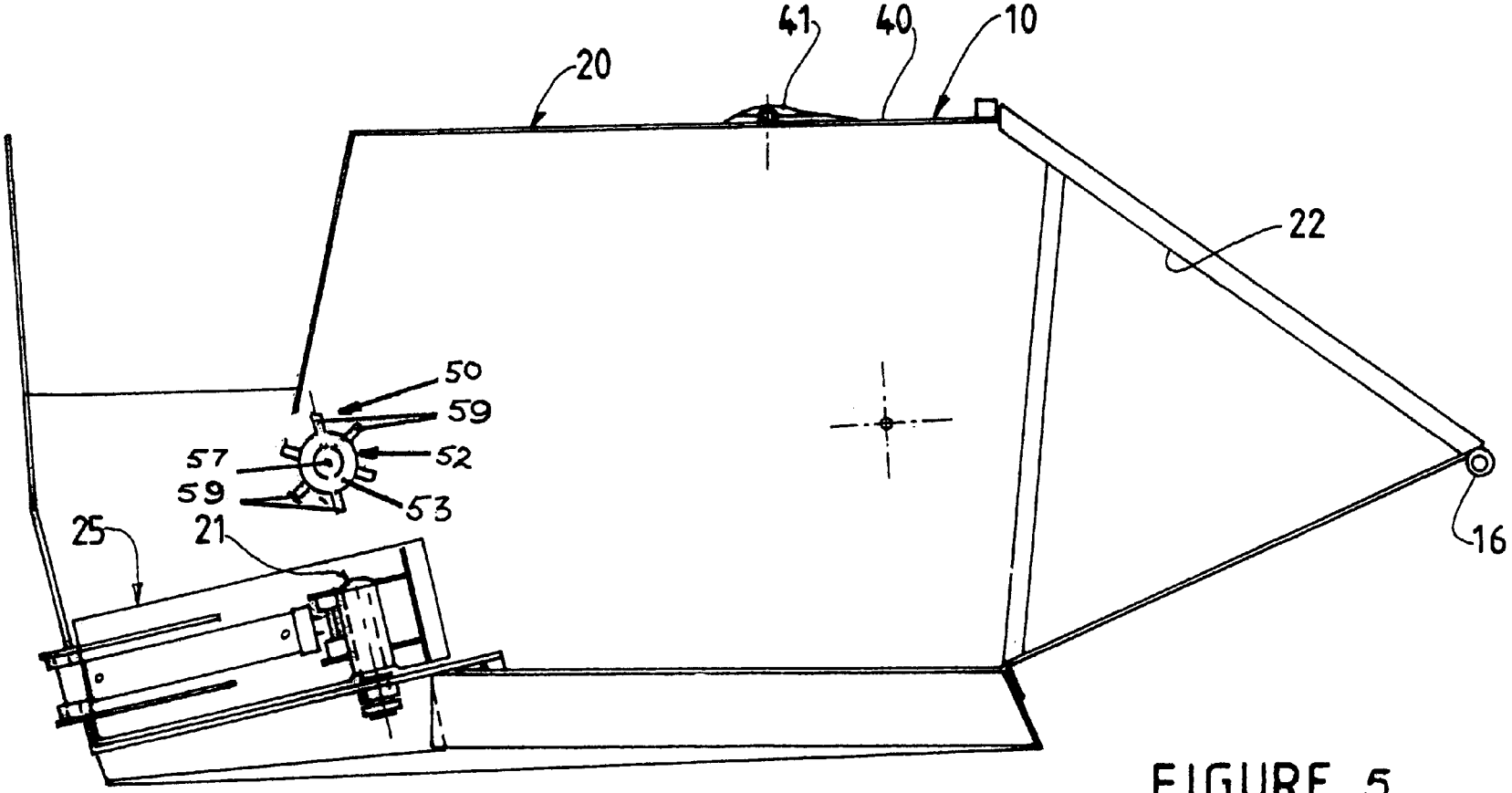
FIG. 5 is a schematic side elevation of another embodiment of refuse handling assembly the improvement according to the invention.
Figure 6:
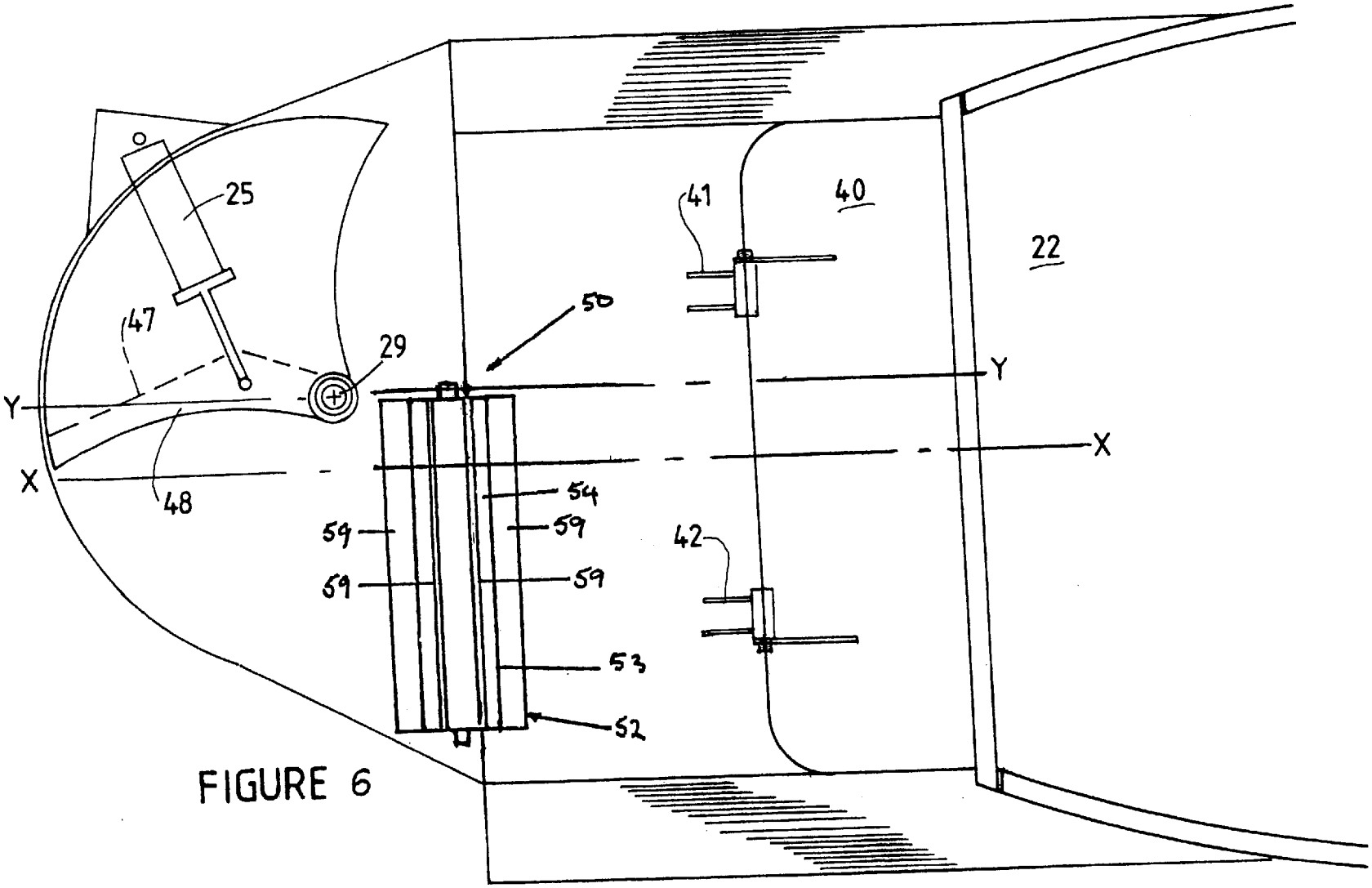
FIG. 6 is a schematic plan view of the assembly shown in FIG. 3.
Figure 7:
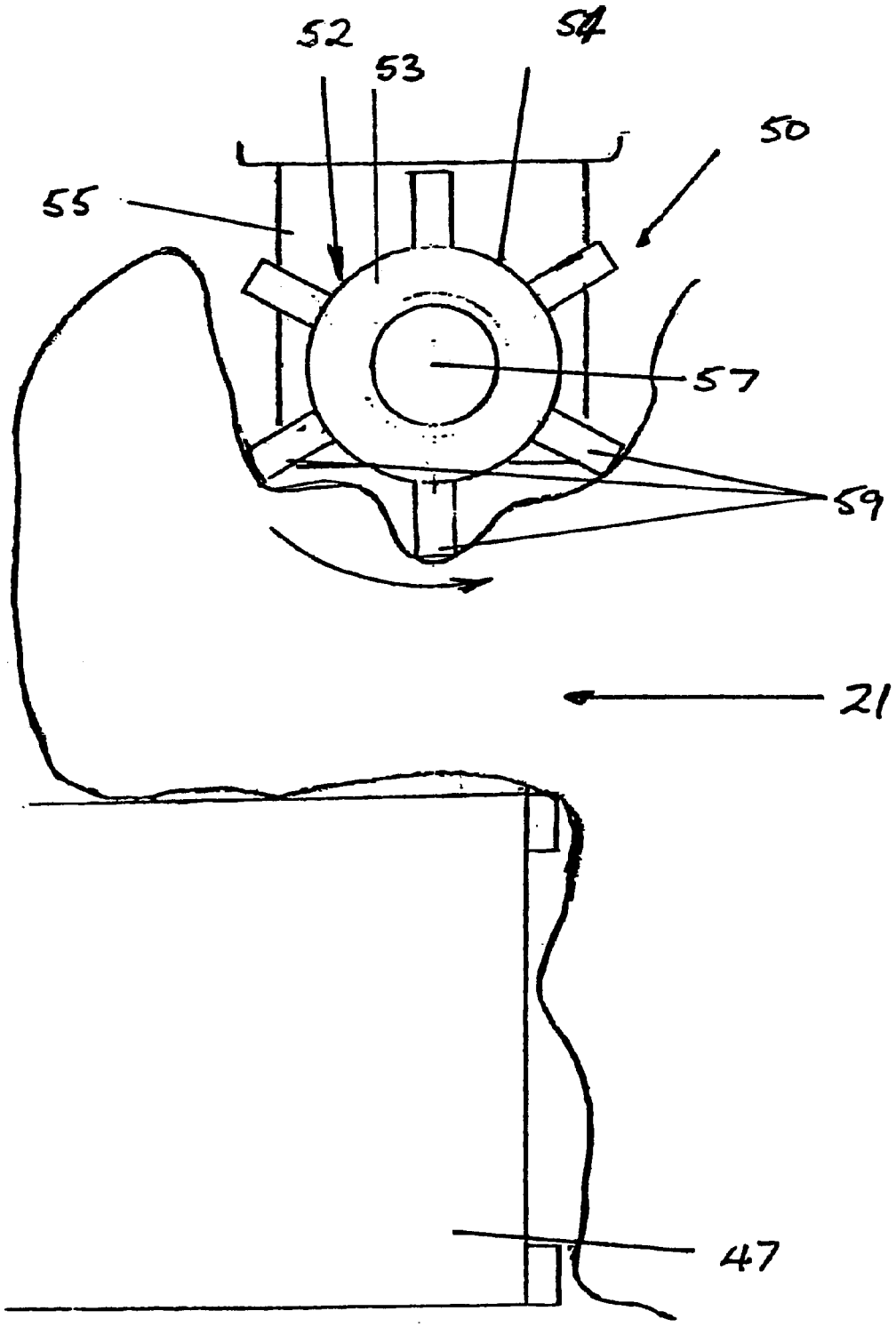
FIG. 7 is a schematic detail of the improved assembly according to the invention.

As shown in FIG. 5 and 7 the refuse handling assembly according to a modified form of the present invention includes feed control means 50 in the form of a rotatable roller or drum 52 having a body portion 53 with an outer cylindrical surface 54. The roller or drum is mounted to flange 55 on the receptacle 20 for rotation about a central rotation axis 57. The roller or drum 52 is mounted in the region of the delivery inlet opening 21 towards the upper section thereof.

The roller or drum 52 further includes a plurality of radially extending flanges or paddles 59 (six are shown) which are secured or formed integral with the outer cylindrical surface 54 of the body portion 53 and extend along that surface in a direction generally parallel to the rotation axis 57. As shown the flanges project from the outer surface 57 and are circumferentially spaced therearound.

As best seen in FIG. 7 as the sweep blade 47 is swung to urge refuse through the inlet opening 21, the refuse engages the flanges 59 and causes the roller or drum 52 to rotate in the direction of the arrow. Thus, the refuse is substantially free to pass through the inlet opening 21 into the receptacle.

The roller or drum 52 is prevented from rotation in the opposite direction by suitable means. Thus, when the sweeper blade is retracted the flanges or paddles 59 tend to inhibit the return of refuse through the inlet opening from the interior of the receptacle.

Finally, it is to be understood that various alterations, modifications and/or additions may be incorporated into the various constructions and arrangements of parts without departing from the spirit or ambit of the invention.

We claim:

1. A refuse handling assembly for use with a vehicle, the vehicle including a forward end and a rear end, the refuse handling assembly including:

a receptacle for receiving refuse, the receptacle including a delivery inlet opening at the forward end of the receptacle and a discharge outlet opening at the rear end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle, wherein the vehicle includes a chassis having a base section with a rear end, the refuse handling assembly further including a support frame which is operatively connected to or forms part of the vehicle chassis and includes a mounting section which extends upwardly from the base section of the vehicle chassis and has a free end portion which is spaced from the base section of the vehicle chassis, said receptacle being mounted to said support frame for pivotal movement about a pivot mounting at or near the free end portion of the mounting section of the support frame for pivotal movement between the lowered position and the tilted position.

2. A refuse handling assembly according to claim 1, wherein said free end portion of said mounting section of said support frame is disposed rearwardly of the rear end of said base section of said vehicle chassis.

3. A refuse handling assembly for use with a vehicle, the vehicle including a forward end and a rear end, the refuse handling assembly including:

a receptacle for receiving refuse, the receptacle including a delivery inlet opening at the forward end of the receptacle and a discharge outlet opening at the rear end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle, wherein said receptacle includes a bottom wall having a first section which is adjacent the base section of the chassis when the receptacle is in the lowered position and a second section which is inclined upwardly from the first section and terminates at or in the region of the discharge outlet opening.

4. A refuse handling assembly for use with a vehicle, the vehicle including a forward end and a rear end, the refuse handling assembly including:

a receptacle for receiving refuse, the receptacle including a delivery inlet opening at the forward end of the receptacle and a discharge outlet opening at the rear end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle, further including a closure assembly for said discharge outlet opening, said closure assembly including a door which is movable between a closed position wherein it covers the discharge outlet opening and an open position, and wherein said closure includes a control pivot arm one end of which is operatively connected to the door and the other end is mounted for pivotal movement so as to move the door between its open and closed positions.

5. A refuse handling assembly according to claim 4, wherein there is provided a coupling section for said door which includes a pin which is receivable within a slot for causing pivotal movement and limited linear movement of the pin relative to the slot.

6. A refuse handling assembly according to claim 5, further including a stabilizer arm extending between the pivot arm and the door.

7. A refuse handling assembly for use with a vehicle, the vehicle including a forward end and a rear end, the refuse handling assembly including:

a receptacle for receiving refuse, the receptacle including a delivery inlet opening at the forward end of the receptacle and a discharge outlet opening at the rear end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle, further including a closure assembly which includes a door movable between a closed position which abuts against an abutment at the periphery of the discharge outlet opening and an open position, the closure assembly further including a control arm operatively connected to the door and mounted for pivotal movement and limited linear movement so as to move the door between its open and closed positions, the arrangement being such that when the door is to be moved between its closed position to its open position the control arm is first caused to move in the limited linear fashion so that the door is moved to a displaced position in which is clear of the abutment and thereafter the control arm is caused to move in the pivotal fashion to move the door into its open position, and the door is to be moved from its open position to its closed position the control arm first moves in the pivotal fashion until the door is in the displaced position and thereafter the arm is caused to move in the linear manner so that the door is caused to abut against the abutment.

8. A refuse handling assembly for use with a vehicle, the vehicle including a forward end and a rear end, the refuse handling assembly including:

a receptacle for receiving refuse, the receptacle including a delivery inlet opening at the forward end of the receptacle and a discharge outlet opening at the rear end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which has its pivot axis laterally offset with respect to the longitudinal axis of the receptacle, further including feed control means which includes one or more projections adapted to extend into the region of the delivery inlet opening and movable in the feed direction but normally inhibited from movement in a direction opposite to the feed direction.

9. Refuse handling apparatus according to claim 8, wherein the feed control means includes a main body which is mounted for rotation there being a plurality of the projections extending from the main body so that rotation thereof causes the projections to pass through the region of the delivery inlet opening in the feed direction.

10. Refuse handling apparatus according to claim 9, wherein the main body of the feed control means comprises a roller or drum which is operatively mounted to the receptacle or vehicle body for rotation about a generally horizontal axis, the projections being adapted to extend generally radially from the surface of the roller or drum.

11. Refuse handling apparatus according to claim 10, wherein the projections include a plurality of elongated upstanding flanges or paddles secured to the outer drum surface and extending generally in the longitudinal direction parallel to the rotation axis and projecting from the outer roller or drum surface.

12. Refuse handling apparatus according to claim 11, wherein a plurality of flanges or paddles are provided which are spaced from one another circumferentially around the roller or drum surface.

13. Refuse handling apparatus according to claim 10, wherein the projections include a plurality of tynes disposed over the outer roller or drum surface in spaced relation from one another and extending therefrom in a generally radial direction.

14. Refuse handling apparatus according to claim 10, wherein the roller or drum is mounted in a roller load bearing and has associated therewith a clutch which permits rotation in one direction only.

15. Refuse handling apparatus according to claim 10, wherein the roller may be mounted towards the top of the delivery inlet opening or alternatively towards the bottom of the opening.

16. A refuse handling assembly for use with a vehicle, the vehicle including a forward end and a rear end, the refuse handling assembly including:

a receptacle for receiving refuse, the receptacle including a forward end, a rearward end, spaced apart sides extending between the forward and rearward ends, a delivery inlet opening at the forward end of the receptacle and a discharge outlet opening at the rearward end of the receptacle, said receptacle being operatively mounted to the vehicle for pivotal movement about a pivot mounting at or near the rear end of the vehicle for pivotal movement between a lowered position and a tilted position and a compactor at the delivery inlet opening having a sweep blade which is mounted for swinging movement about a generally upright pivot axis which is laterally offset towards one side with respect to a central longitudinal axis of the receptacle which extends between the forward and rearward ends of the receptacle.

17. A refuse handling assembly according to claim 16, wherein the sweep blade includes a panel having a curved front face, the blade being operatively mounted to a pivot shaft for swinging movement forwards and backwards in a generally horizontal plane, the refuse being carried into the receptacle during forward movement of the panel.

18. A refuse handling assembly according to claim 17, wherein the panel projects into the receptacle at the ends of its forward travel.

19. A refuse handling assembly according to claim 18, wherein the compactor includes a base wall which is slightly inclined relative to the base wall section of the receptacle and the pivot axis of the sweep blade is inclined so that the sweep plane is substantially parallel to the base wall.

* * * * *